US008679040B2

(12) United States Patent
Horst

(10) Patent No.: US 8,679,040 B2
(45) Date of Patent: Mar. 25, 2014

(54) INTENTION-BASED THERAPY DEVICE AND METHOD

(75) Inventor: Robert W. Horst, San Jose, CA (US)

(73) Assignee: AlterG, Inc., Fremont, CA (US)

( * ) Notice: Subject to any disclaimer, the term of this patent is extended or adjusted under 35 U.S.C. 154(b) by 0 days.

(21) Appl. No.: 13/290,980

(22) Filed: Nov. 7, 2011

(65) Prior Publication Data

US 2012/0053498 A1 Mar. 1, 2012

Related U.S. Application Data

(60) Continuation of application No. 12/860,735, filed on Aug. 20, 2010, which is a continuation of application No. 12/205,705, filed on Sep. 5, 2008, which is a continuation of application No. 11/221,452, filed on Sep. 7, 2005, now Pat. No. 7,537,573, which is a division of application No. 10/704,483, filed on Nov. 6, 2003, now Pat. No. 6,966,882.

(60) Provisional application No. 60/485,882, filed on Jul. 8, 2003, provisional application No. 60/429,289, filed on Nov. 25, 2002.

(51) Int. Cl.

| | |
|---|---|
| ***A61H 1/00*** | (2006.01) |
| ***A61H 1/02*** | (2006.01) |
| ***A61H 5/00*** | (2006.01) |

(52) U.S. Cl.

USPC ..... 601/5; 601/34

(58) Field of Classification Search

USPC ..... 601/5, 33, 35, 34; 482/5; 600/587, 595

See application file for complete search history.

(56) References Cited

U.S. PATENT DOCUMENTS

| | | | |
|---|---|---|---|
| 1,286,482 | A | 12/1918 | Yoder |
| 1,366,904 | A | 2/1921 | Davis |
| 1,391,290 | A | 9/1921 | Welffens |
| 1,513,473 | A | 10/1924 | Ackerman |
| 1,739,053 | A | 12/1929 | Wilhelm |

(Continued)

FOREIGN PATENT DOCUMENTS

| | | | |
|---|---|---|---|
| EP | 1138286 | A2 | 10/2001 |
| EP | 1410780 | A1 | 4/2004 |

(Continued)

OTHER PUBLICATIONS

Advanced Mechatronics Lab (Univ. of Tokyo); Dual Excitation Multiphase Electrostatic Drive (DEMED); http://www.intellect.pe.u-tokyo.ac.jp/research/es_motor/demed_e.html; pp. 1-5; (printed) Nov. 21, 2002.

(Continued)

*Primary Examiner* — Kristen Matter
(74) *Attorney, Agent, or Firm* — Shay Glenn LLP

(57) ABSTRACT

A method for controlling movement using an active powered device including an actuator, joint position sensor, muscle stress sensor, and control system. The device provides primarily muscle support although it is capable of additionally providing joint support (hence the name "active muscle assistance device"). The device is designed for operation in several modes to provide either assistance or resistance to a muscle for the purpose of enhancing mobility, preventing injury, or building muscle strength. The device is designed to operate autonomously or coupled with other like device(s) to provide simultaneous assistance or resistance to multiple muscles.

15 Claims, 10 Drawing Sheets

(56) References Cited

U.S. PATENT DOCUMENTS 1,847,720 A 3/1932 Marcellis
2,169,813 A 8/1939 Parkin
3,059,490 A 10/1962 McDuffie
3,200,666 A 8/1965 Schrodt et al.
3,358,678 A 12/1967 Kultsar
3,398,248 A 8/1968 Klauss et al.
3,402,942 A 9/1968 Shimano et al.
3,631,542 A 1/1972 Potter
3,641,843 A 2/1972 Lemmens
3,863,512 A 2/1975 Crawley
3,899,383 A 8/1975 Schultz et al.
3,925,131 A 12/1975 Krause
3,976,057 A 8/1976 Barclay
4,474,176 A 10/1984 Farris et al.
4,507,104 A 3/1985 Clark et al.
4,538,595 A 9/1985 Hajianpour
4,549,555 A 10/1985 Fraser et al.
4,588,040 A 5/1986 Albright, Jr. et al.
4,649,488 A 3/1987 Osanai et al.
4,678,354 A 7/1987 Olsen
4,679,548 A 7/1987 Pecheux
4,691,694 A 9/1987 Boyd et al.
4,697,808 A 10/1987 Larson et al.
4,731,044 A 3/1988 Mott
4,745,930 A 5/1988 Confer
4,754,185 A 6/1988 Gabriel et al.
4,796,631 A 1/1989 Grigoryev
4,801,138 A 1/1989 Airy et al.
4,807,874 A 2/1989 Little
4,872,665 A 10/1989 Chareire
4,878,663 A 11/1989 Luquette
4,883,445 A 11/1989 Gomoll et al.
4,922,925 A 5/1990 Crandall et al.
4,934,694 A 6/1990 McIntosh
4,944,713 A 7/1990 Salerno
4,953,543 A 9/1990 Grim et al.
4,981,116 A 1/1991 Trinquard
4,983,146 A 1/1991 Charles et al.
5,020,790 A 6/1991 Beard et al.
5,052,681 A 10/1991 Williams
5,078,152 A 1/1992 Bond et al.
5,117,814 A 6/1992 Luttrell et al.
5,170,776 A 12/1992 Pecheux
5,170,777 A 12/1992 Reddy et al.
5,195,617 A 3/1993 Clemens
5,203,321 A 4/1993 Donovan et al.
5,209,223 A 5/1993 McGorry et al.
5,213,094 A 5/1993 Bonutti
5,239,222 A 8/1993 Higuchi et al.
5,241,952 A 9/1993 Ortiz
5,282,460 A 2/1994 Boldt
5,303,716 A 4/1994 Mason et al.
5,313,968 A 5/1994 Logan et al.
5,345,834 A 9/1994 Hayashi
5,358,468 A 10/1994 Longo et al.
5,378,954 A 1/1995 Higuchi et al.
5,395,303 A 3/1995 Bonutti et al.
5,421,798 A 6/1995 Bond et al.
5,440,945 A 8/1995 Penn
5,448,124 A 9/1995 Higuchi et al.
5,463,526 A 10/1995 Mundt
5,476,441 A 12/1995 Durfee et al.
5,509,894 A 4/1996 Mason et al.
5,520,627 A 5/1996 Malewicz
5,525,642 A 6/1996 Cipriano et al.
5,534,740 A 7/1996 Higuchi et al.
5,541,465 A 7/1996 Higuchi et al.
5,582,579 A 12/1996 Chism et al.
5,585,683 A 12/1996 Higuchi et al.
5,608,599 A 3/1997 Goldman
5,624,390 A 4/1997 Van Dyne
5,653,680 A 8/1997 Cruz
5,662,594 A 9/1997 Rosenblatt
5,662,693 A 9/1997 Johnson et al.
5,674,262 A 10/1997 Tumey
5,683,351 A 11/1997 Kaiser et al.
5,704,440 A 1/1998 Urban et al.
5,708,319 A 1/1998 Ban et al.
5,728,017 A 3/1998 Bellio et al.
5,746,684 A 5/1998 Jordan
5,746,704 A 5/1998 Schenck et al.
5,755,303 A 5/1998 Yamamoto et al.
5,789,843 A 8/1998 Higuchi et al.
5,833,257 A 11/1998 Kohlheb et al.
5,865,770 A 2/1999 Schectman
5,916,689 A 6/1999 Collins et al.
5,931,756 A 8/1999 Ohsono et al.
5,976,063 A 11/1999 Joutras et al.
6,001,075 A 12/1999 Clemens et al.
6,033,330 A 3/2000 Wong et al.
6,062,096 A 5/2000 Lester
6,119,539 A 9/2000 Papanicolaou
6,146,341 A 11/2000 Sato et al.
6,149,612 A 11/2000 Schnapp et al.
6,162,189 A 12/2000 Girone et al.
6,183,431 B1 2/2001 Gach, Jr.
6,217,532 B1 4/2001 Blanchard et al.
6,221,032 B1 4/2001 Blanchard et al.
6,290,662 B1 9/2001 Morris et al.
6,314,835 B1 11/2001 Lascelles et al.
6,440,093 B1 8/2002 McEwen et al.
6,472,795 B2 10/2002 Hirose et al.
6,494,798 B1 12/2002 Onogi
6,500,138 B1 * 12/2002 Irby et al. ..... 602/26
6,517,503 B1 2/2003 Naft et al.
6,525,446 B1 2/2003 Yasuda et al.
6,527,671 B2 3/2003 Paalasmaa et al.
6,533,742 B1 3/2003 Gach, Jr.
6,537,175 B1 3/2003 Blood
6,554,773 B1 4/2003 Nissila et al.
6,572,558 B2 6/2003 Masakov et al.
6,599,255 B2 7/2003 Zhang
6,659,910 B2 12/2003 Gu et al.
6,666,796 B1 12/2003 MacCready, Jr.
6,689,075 B2 2/2004 West
6,694,833 B2 2/2004 Hoehn et al.
6,770,045 B2 * 8/2004 Naft et al. ..... 602/16
6,796,926 B2 9/2004 Reinkensmeyer et al.
6,805,677 B2 10/2004 Simmons
6,836,744 B1 12/2004 Asphahani et al.
6,936,994 B1 8/2005 Gimlan
6,966,882 B2 11/2005 Horst
7,041,069 B2 5/2006 West
7,124,321 B2 10/2006 Garnett et al.
7,171,331 B2 1/2007 Vock et al.
7,192,401 B2 3/2007 Saalasti et al.
7,239,065 B2 7/2007 Horst
7,324,841 B2 1/2008 Reho et al.
7,365,463 B2 4/2008 Horst et al.
7,410,471 B1 * 8/2008 Campbell et al. ..... 602/16
7,416,537 B1 8/2008 Stark et al.
7,537,573 B2 5/2009 Horst
7,559,909 B2 7/2009 Katoh et al.
7,648,436 B2 1/2010 Horst et al.
7,998,092 B2 * 8/2011 Avni et al. ..... 600/587
2001/0029343 A1 10/2001 Seto et al.
2002/0128552 A1 9/2002 Nowlin et al.
2003/0104886 A1 6/2003 Gajewski
2003/0120183 A1 6/2003 Simmons
2003/0195638 A1 10/2003 Kajitani et al.
2003/0212356 A1 * 11/2003 Scorvo ..... 602/20
2004/0049139 A1 3/2004 Craciunescu
2004/0078091 A1 4/2004 Elkins
2004/0106881 A1 6/2004 McBean et al.
2005/0014600 A1 1/2005 Clauson
2005/0151420 A1 7/2005 Crombez et al.
2005/0221926 A1 10/2005 Naude
2006/0132069 A1 6/2006 Hemphill et al.
2006/0293624 A1 12/2006 Enzerink et al.
2007/0056592 A1 * 3/2007 Angold et al. ..... 128/845
2007/0155557 A1 7/2007 Horst et al.
2007/0155558 A1 7/2007 Horst et al.
2007/0155560 A1 7/2007 Horst et al.
2007/0270265 A1 11/2007 Miller et al.

(56) References Cited

U.S. PATENT DOCUMENTS

| | | | | |
|---|---|---|---|---|
| 2008/0195005 | A1 | 8/2008 | Horst et al. | |
| 2008/0287850 | A1* | 11/2008 | Adarraga | 602/26 |
| 2009/0036804 | A1 | 2/2009 | Horst | |
| 2009/0171469 | A1* | 7/2009 | Thorsteinsson et al. | 623/26 |
| 2009/0204038 | A1 | 8/2009 | Smith et al. | |
| 2009/0306548 | A1 | 12/2009 | Bhugra et al. | |
| 2010/0038983 | A1 | 2/2010 | Bhugra et al. | |
| 2010/0039052 | A1 | 2/2010 | Horst et al. | |
| 2010/0211355 | A1 | 8/2010 | Horst et al. | |
| 2010/0280628 | A1 | 11/2010 | Sankai | |
| 2010/0318006 | A1 | 12/2010 | Horst | |

FOREIGN PATENT DOCUMENTS

| | | | |
|---|---|---|---|
| JP | 63-136978 | A | 6/1988 |
| JP | 02-275162 | A | 11/1990 |
| JP | 04-104180 | A | 4/1992 |
| JP | 05-038948 | A | 2/1993 |
| JP | 05-260766 | | 10/1993 |
| JP | 06-038551 | A | 2/1994 |
| JP | 07-274540 | A | 10/1995 |
| JP | 08-033360 | A | 2/1996 |
| JP | 08-149858 | | 6/1996 |
| JP | 08-154304 | A | 6/1996 |
| JP | 09-133196 | A | 5/1997 |
| JP | 09-261975 | A | 10/1997 |
| JP | 2001-353675 | A | 12/2001 |
| JP | 2002-191654 | A | 7/2002 |
| WO | WO 90/11049 | A1 | 10/1990 |

OTHER PUBLICATIONS

Advanced Mechatronics Lab (Univ. of Tokyo); High-power electrostatic motor; http://www.intellect.pe.u-tokyo.ac.jp/research/es_motor/es_motor_e.html; pp. 1-2; (printed) Nov. 21, 2002.

Advanced Mechatronics Lab (Univ. of Tokyo); Pulse driven induction electrostatic motor; http://www.intellect.pe.u-tokyo.ac.jp/research/es_motor/pim_e.html; pp. 1-5; (printed) Nov. 21, 2002.

Asel (Univ. of Delaware); Powered orthosis project; http://www.asel.udel.edu/robotics/orthosis/orthosis.html, 1 pg.; (update) Jan. 17, 1999.

British Tech. Group; Demonstration of energy saving in vehicles by integrating an infinitely variable transmission with an optimized petrol engine; prj. No. TR/00087/92; pp. 1-19; (version) Jul. 15, 1998.

Fitch, C. J.; Development of the electrostatic clutch; IBM Journal; pp. 49-56; Jan. 1957.

Gongola et al.; Design of a PZT-actuated proportional drum brake; IEEE ASME Trans. on Mech.; vol. 4; No. 4; pp. 409-416; Dec. 1999.

Howard Leitch, PPT Ltd.; Waveform Gearing; Motion System Design; pp. 33-35; Nov. 2002.

Kawamoto et al.; Power assist system HAL-3 for GAIT disorder person; ICCHP 2002; LNCS 2398; pp. 196-203; 2002.

Kim et al.; On the energy efficiency of CVT-based mobile robots; Proc. 2000 IEEE; Int. Conf. on Robotics & Automation; pp. 1539-1544; San Francisco, CA; Apr. 2000.

Kluger et al.; An overview of current automatic, manual and continuously variable transmission efficiencies and their projected future improvements; Int. Congress and Expo. (No. 1999-1-1259); pp. 1-6; Detroit, MI; Mar. 1-4, 1999.

Misuraca et al.; Lower limb human enhancer; Int. Mech. Eng. Conf. and Expo.; New York, NY; pp. 1-7; Nov. 11-16, 2001.

Niino et al.; Electrostatic artificial muscle: compact, high-power linear actuators with multiple-layer structures; Proc. IEEE Workshop on Micro Electro Mechanical Systems; Oiso, Japan; pp. 130-135; Jan. 1994.

Ohhashi, Toshio et al.; Human perspiration measurement; Physiological Measurement; vol. 19; pp. 449-461; 1998.

Otto Bock Health Care; (3C100 C-Leg® System) Creating a new standard for prosthetic control; http://www.ottobockus.com/products/op_lower_cleg.asp; pp. 1-2; (printed) Nov. 22, 2002.

Otto Bock Health Care; (3C100 C-Leg® System) New generation leg system revolutionizes lower limb prostheses; http://www.ottobockus.com/products/op_lower_cleg4.asp; pp. 1-2; (printed) Nov. 22, 2002.

Patras et al.; Electro-rheological fluids in the design of clutch systems for robotic applications; IEEE; pp. 554-558; Nov. 11-13, 1992.

Powell et al.; Computer model for a parallel hybrid electric vehicle (PHEV) with CVT; Proc. AACC; pp. 1011-1015; Chicago, IL; Jun. 2000.

Shriner'S Hospitals; Your new orthosis; http://www.shrinershq.org/patientedu/orthosis.html; pp. 1-3; (printed) Nov. 22, 2002.

Takesue et al.; Development and experiments of actuator using MR fluid; IEEE; pp. 1838-1843; 2000.

Townsend Design; Functional Bracing Solutions (AIR Townsend & Ultra AIR); http://www.townsenddesign.com/air.html; 2 pgs; (printed) Nov. 21, 2002.

Townsend Design; Functional Knee Bracing Solutions; http://www.townsenddesign.com/functional.html; pp. 1; (printed) Nov. 21, 2002.

Townsend Design; Patented Motion Hinge (Planes of Motion); http://www.townsenddesign.com/motion.html; pp. 1; (printed) Nov. 21, 2002.

Trimmer et al.; An operational harmonic electrostatic motor; IEEE; pp. 13-16; 1989.

Smith et al., U.S. Appl. No. 12/471,299 entitled "Therapy and mobility assistance system," filed May 22, 2009.

Bhugra, Kern; U.S. Appl. No. 12/363,567 entitled "System and method for controlling the joint motion of a user based on a measured physiological property," filed Jan. 30, 2009.

Smith et al.; U.S. Appl. No. 13/274,109 entitled "Multi-fit orthotic and mobility assistance apparatus," filed Oct. 14, 2011.

* cited by examiner

INTENTION-BASED THERAPY DEVICE AND METHOD

CROSS REFERENCE TO RELATED APPLICATIONS

The present application is a continuation of pending U.S. patent application Ser. No. 12/860,735 filed Aug. 20, 2010, entitled, "INTENTION-BASED THERAPY DEVICE AND METHOD" which is a continuation of pending U.S. patent application Ser. No. 12/205,705, filed on Sep. 5, 2008, entitled "POWER REGENERATION IN ACTIVE MUSCLE ASSISTANCE DEVICE AND METHOD", which is a continuation of U.S. patent application Ser. No. 11/221,452 filed on Sep. 7, 2005, now U.S. Pat. No. 7,537,573, issued on May 26, 2009, entitled "ACTIVE MUSCLE ASSISTANCE AND RESISTANCE DEVICE AND METHOD", which is a divisional of U.S. patent application Ser. No. 10/704,483 filed on Nov. 6, 2003, now U.S. Pat. No. 6,966,882, issued on Nov. 25, 2005, entitled "ACTIVE MUSCLE ASSISTANCE DEVICE AND METHOD", which claims the benefit of U.S. Provisional Application No. 60/485,882, filed Jul. 8, 2003, entitled "ELECTROSTATIC ACTUATOR WITH FAULT TOLERANT ELECTROSTATIC STRUCTURE" and U.S. Provisional Application No. 60/429,289, filed Nov. 25, 2002, entitled "ACTIVE MUSCLE ASSISTANCE DEVICE" all of which are hereby incorporated by reference in their entirety.

INCORPORATION BY REFERENCE

All publications and patent applications mentioned in this specification are herein incorporated by reference to the same extent as if each individual publication or patent application was specifically and individually indicated to be incorporated by reference.

BACKGROUND OF THE INVENTION

There is a strong need for devices to assist individuals with impaired mobility due to injury or illness. Current devices include passive and active assistance and support devices, mobility devices and strength training devices.

Strength training devices, such as weights and exercise equipment, provide no assistance in mobility. Nor do such devices provide joint support or muscle support or augmentation.

Passive assistance devices, such as canes, crutches, walkers and manual wheelchairs, provide assistance with mobility. However, individuals using such devices must supply all of the power needed by exerting forces with other muscles to compensate for the one that is weak or injured. Additionally, passive assistance devices provide limited mobility.

Alternatively, passive support devices (passive orthoses), such as ankle, knee, elbow, cervical spine (neck), thoracic spine (upper back), lumbar spine (lower back), hip or other support braces, provide passive joint support (typically support against gravity) and in some cases greater mobility. Similarly, however, using such devices requires individuals to exert force with a weak muscle for moving the supported joint. Moreover, manual clutch-based braces require the user to activate a brace lock mechanism in order to maintain a joint flexion or extension position. This limits the user to modes of operation in which the position is fixed, or in which the device provides no support or assistance.

By comparison, powered assistive devices, such as foot-ankle-knee-hip orthosis or long-leg braces, provide assistance in movement and support against gravity. A powered foot-ankle-knee-hip orthosis is used to assist individuals with muscular dystrophy or other progressive loss of muscle function. The powered foot-ankle-knee-hip orthosis is also used for locomotive training of individuals with spinal cord injuries. However, this type of powered foot-ankle-knee-hip orthosis typically uses a pneumatic or motorized actuator that is non-portable. Another type of device, the electronically controlled long-leg brace, provides no added force to the user and employs an electronically-controlled clutch that locks during the weight bearing walk phase. This limits the mobility of the user when walking in that the user's leg remains locked in extended position (without flexing).

A mobility assistance device such as the C-Leg®, is a microprocessor-controlled knee-shin prosthetic system with settings to fit the individual's gait pattern and for walking on level and uneven terrain and down stairs. (See, e.g., the Otto Bock Health Care's 3C100 C-Leg® System). Obviously, since this rather costly system is fitted as a lower limb prostheses for amputees it is not useful for others who simply need a muscle support or augmentation device.

A number of power assist systems have been proposed for providing weight bearing gait support. One example known as the lower limb muscle enhancer is configured as a pneumatically actuated exoskeleton system that attaches to the foot and hip. This muscle enhancer uses two pneumatic actuators, one for each leg. It converts the up and down motion of a human's center of gravity into potential energy which is stored as pneumatic pressure. The potential (pneumatic) energy is used to supplement the human muscle while standing up or sitting down, walking or climbing stairs. Control of the system is provided with pneumatic sensors implanted into the shoes. Each shoe is also fitted with fastener that receives one end of the rod side of a pneumatic actuator, the other end of the rod extending into the cylinder side of the actuator. Although the cylinder is provided with a ball swivel attachment to the hip shell, the hip, leg and foot movements are somewhat limited by the actuator's vertically-aligned compression and extension. The pneumatic actuator helps support some of the body weight by transmitting the body weight to the floor partially bypassing the legs. All control components, power supply, and sensors are mounted on a backpack. Thus, among other limitations, it is relatively uncomfortable and burdensome.

Another powered assistive device is a hybrid assistive leg that provides self-walking aid for persons with gait disorders. The hybrid assistive leg includes an exoskeletal frame, an actuator, a controller and a sensor. The exoskeletal frame attaches to the outside of a lower limb and transmits to the lower limb the assist force which is generated by the actuator. The actuator has a DC-motor, and a large reduction gear ratio, to generate the torque of the joint. The sensor system is used for estimating the assist force and includes a rotary encoder, myoelectric sensors, and force sensors. The encoder measures the joint angle, the force sensors, installed in the shoe sole, measure the foot reaction force, and the myoelectric sensor, attached to the lower limb skin surface, measures the muscle activity. Much like the aforementioned muscle enhancer, the controller, driver circuits, power supply and measuring module are packed in a back pack. This system is thus as cumbersome as the former, and both are not really suitable for use by elderly and infirm persons.

Active mobility devices, such as motorized wheelchairs, provide their own (battery) power, but have many drawbacks in terms of maneuverability, use on rough terrain or stairs, difficulty of transportation, and negative influence on the self-image of the patient.

Currently there is a need to fill the gap between passive support devices and motorized wheelchairs. Furthermore, there is a need to remedy the deficiencies of muscle or joint support and strength training devices as outlined above. The present invention addresses these and related issues.

SUMMARY OF THE INVENTION

In accordance with the aforementioned purpose, the present invention helps fill the gap between passive support devices and motorized wheelchairs by providing an active device. In a representative implementation, the active device is an active muscle assistance device. The active assistance device is configured with an exoskeletal frame that attaches to the outside of the body, e.g., lower limb, and transmits an assist or resist force generated by the actuator. The active assistance device provides primarily muscle support although it is capable of additionally providing joint support (hence the name "active muscle assistance device"). As compared to passive support devices, this device does not add extra strain to other muscle groups. The active muscle assistance device is designed to operate in a number of modes. In one operation mode it is designed to provide additional power to muscles for enhancing mobility. In another operation mode, it is designed to provide resistance to the muscle to aid in rehabilitation and strength training. The active muscle assistance device is attached to a limb or other part of the body through straps or other functional bracing. It thus provides muscle and/or joint support while allowing the individual easy maneuverability as compared to the wheelchair-assisted maneuverability. An individual can be fitted with more than one active muscle support device to assist different muscles and to compensate for weakness in a group of muscles (such as leg and ankle) or bilateral weaknesses (such as weak quadriceps muscles affecting the extension of both knees).

The active muscle support device is driven by an actuator, such as motor, linear actuator, or artificial muscle that is powered by a portable power source such as a battery, all of which fit in a relatively small casing attached to the muscle support device. Many types of actuators can be used in this device. However, to reduce weight, the preferred actuator is one made primarily of polymers and using high voltage activation to provide power based on electrostatic attraction. In one embodiment such actuator is an electrostatic actuator operative, when energized, to exert force between the stationary and moving portions. In this case, the energizing of the electrostatic actuator is controllable for directing the force it exerts so that, when assisting, the force reduces the muscle stress, and, when resisting, the force opposes the joint movement.

A microcontroller-based control system drives control information to the actuator, receives user input from a control panel function, and receives sensor information including joint position and external applied forces. Based on the sensor input and desired operation mode, the control system applies forces to resist the muscle, assist the muscle, or to allow the muscle to move the joint freely. The control system controls the manner in which the actuator is energized for directing the force so that, when assisting, the force reduces the muscle stress and, when resisting, the force opposes joint movement.

In one embodiment of the present invention, a computer system for controlling joint movement is provided. Such computer system includes: a processing unit (microcontroller, microprocessor, etc.) and a memory, both of which operate with the detection means (sensors), and the actuator (preferably electrostatic). The detection means is operative to detect joint movement and muscle stress. The memory has program code for causing the processing unit to receive an indication as to which mode of operation is selected and in response thereto obtain from the detector means, based on the selected mode, an indicia of muscle stress or joint movement, or both. The processor activates the actuator or maintains it idle based on the selected mode of operation and indicia. The available modes of operation include: idle, assist, rehabilitate, resist and monitor mode. For instance, in the assist and rehabilitate modes, the actuator is activated to assist in reducing the muscle stress; and in the resist mode the actuator is activated to resist the joint movement.

In another embodiment, a method is proposed for controlling joint movement and reducing muscle stress. The method includes fastening a powered muscle assistance device with an actuator at points above and below a joint; setting a desired mode of operation of the powered muscle assistance device; detecting, at the powered muscle assistance device, an indicia of joint movement or muscle stress with flexion or extension of the joint; and activating the actuator to exert force. Again, in the assist and rehabilitate modes, the actuator is activated to assist in reducing the muscle stress; and in the resist mode the actuator is activated to resist the joint movement.

As can be appreciated, this approach provides a practical solution for muscle augmentation, for rehabilitation through resistance training, for allowing free movement and for monitoring movement. These and other features, aspects and advantages of the present invention will become better understood from the description herein and accompanying drawings.

BRIEF DESCRIPTION OF THE DRAWINGS

The accompanying drawings which, are incorporated in and constitute a part of this specification, illustrate several embodiments of the invention and together with the description, serve to explain the principles of the invention.

DETAILED DESCRIPTION OF THE INVENTION

General Overview of a Knee Brace

Figure 1:
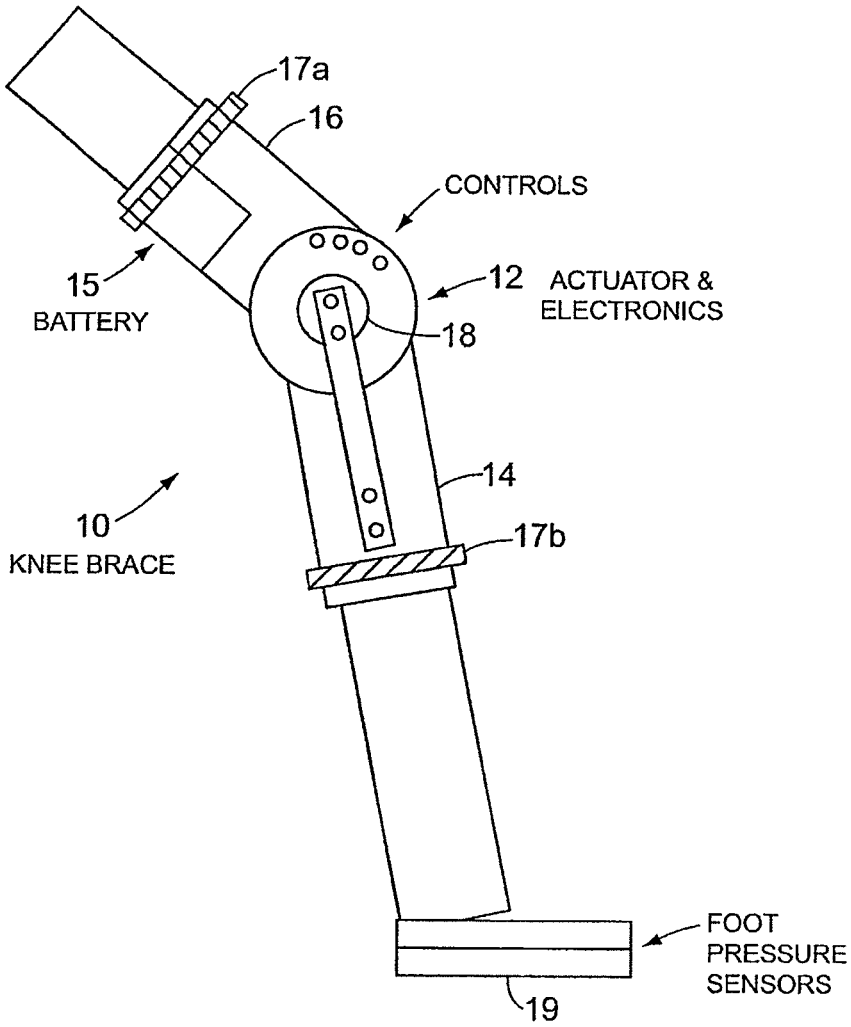
FIG. 1 shows an embodiment of the invention in the form of an active knee brace.

FIG. 1 shows an active muscle support brace according to one embodiment of the invention. The device is an active knee brace used to offload some of the stress from the quadriceps when extending the leg. For different parts of the body, other devices are constructed with a suitable shape, but the principles presented here apply by analogy to such devices. The device is particularly useful in helping someone with muscle weakness in the every day tasks of standing, sitting, walking, climbing stairs and descending stairs. The device can also be used in other modes to help build muscle strength and to monitor movements for later analysis. The support to the muscle is defined by the position of the actuator 12 applying force to the moving parts of the brace. Namely, as the actuator 12 rotates, and with it the moving (rigid) parts of the brace, the position of the actuator 12 defines the relative position of the joint and thereby supporting the corresponding muscle.

Structure and Body Attachment

Each device provides assistance and/or resistance to the muscles that extend and flex one joint. The device does not directly connect to the muscle, but is attached in such a way that it can exert external forces to the limbs. The device is built from an underlying structural frame, padding, and straps (not shown) that can be tightened to the desired pressure. The frame structure with hinged lower and upper portions (14 and 16) as shown is preferably made of lightweight aluminum or carbon fiber.

In this embodiment, the frame is attached to the upper and lower leg with straps held by Velcro or clip-type connectors (not shown). A soft padding material cushions the leg. The brace may come in several standard sizes, or a custom brace can be constructed by making a mold of the leg and building a brace to precisely fit a replica of the leg constructed from the mold.

The attachment of the device to the body is most easily understood with respect to a specific joint, the knee in this case. The structural frame of the device includes a rigid portion above the knee connected to hinges 18 at the medial and lateral sides. The rigid structure goes around the knee, typically around the posterior side, to connect both hinges together. On the upper portion of the brace 16, the rigid portion extends up to the mid-thigh, and on the lower portion 14, it continues down to the mid-calf. In the thigh and calf regions, the frame extends around from medial to lateral sides around approximately half the circumference of the leg. The remaining portion of the circumference is spanned by straps that can be tightened with clips, laces or Velcro closures. Understandably, this allows easier attachment and removal of the device. The rigid portion can be either on the anterior or posterior side, but because this device must exert more pressure to extend the knee than to flex the knee, the preferred structure is to place more of the rigid structure on the posterior side with the straps on the anterior side. The number and width of straps can vary, but the straps must be sufficient to hold the device in place with the axis of rotation of the hinge in approximately the same axis as that of rotation of the knee. The hinge itself may be more complex than a single pivot point to match the rotation of the knee.

Cushioning material may be added to improve comfort. A manufacturer may choose to produce several standard sizes, each with enough adjustments to be comfortable for a range of patients, or the manufacturer may use a mold or tracing of the leg to produce individually customized devices.

As will be later explained in more detail, a microcontroller-based control system drives control information to the actuator, receives user input from a control panel function, and receives sensor information including joint position and external applied forces. For example, pressure information is obtained from the foot-pressure sensor 19. Based on the sensor input and desired operation mode, the control system applies forces to resist the muscle, assist the muscle, or to allow the muscle to move the joint freely.

The actuator 12 is coupled to the brace to provide the force needed to assist or resist the leg muscle(s). Although it is intended to be relatively small in size, the actuator is preferably located on the lateral side to avoid interference with the other leg. The actuator is coupled to both the upper and lower portions of the structural frame to provide assistance and resistance with leg extension and flexion.

As the examples below will demonstrate, the actuator 12 is structured to function as an electrostatic motor, linear or rotational (examples and implementations of electrostatic actuators can also be found in U.S. Pat. Nos. 6,525,446, 5,708,319, 5,541,465, 5,448,124, 5,239,222, which are incorporated herein by reference for this purpose). The idea being that the actuator is configured with the stator and rotor each having a plurality of electrodes electrically driven in opposite direction to cause an electrostatic field and, in turn, movement. The strength of the electrostatic field determines the amount of torque produced by the actuator. The electrostatic motor can be fabricated as a 2-dimension structure that can be easily stacked for producing higher power. This configuration is light weight relative to a 3-dimension structure of electromagnetic motors and can be constructed from light-weight polymers instead of heavy iron-based magnetic materials.

One example of an actuator is known as dual excitation multiphase electrostatic drive (DEMED) consisting of two films, slider and stator, both configured with three-phase parallel electrodes covered with insulating material. The velocity of the movement of the slider relative to the stator is controlled by the electrostatic interaction between the potential waves induced on the electrodes when a-c signals are applied to them, respectively.

Figure 2A:
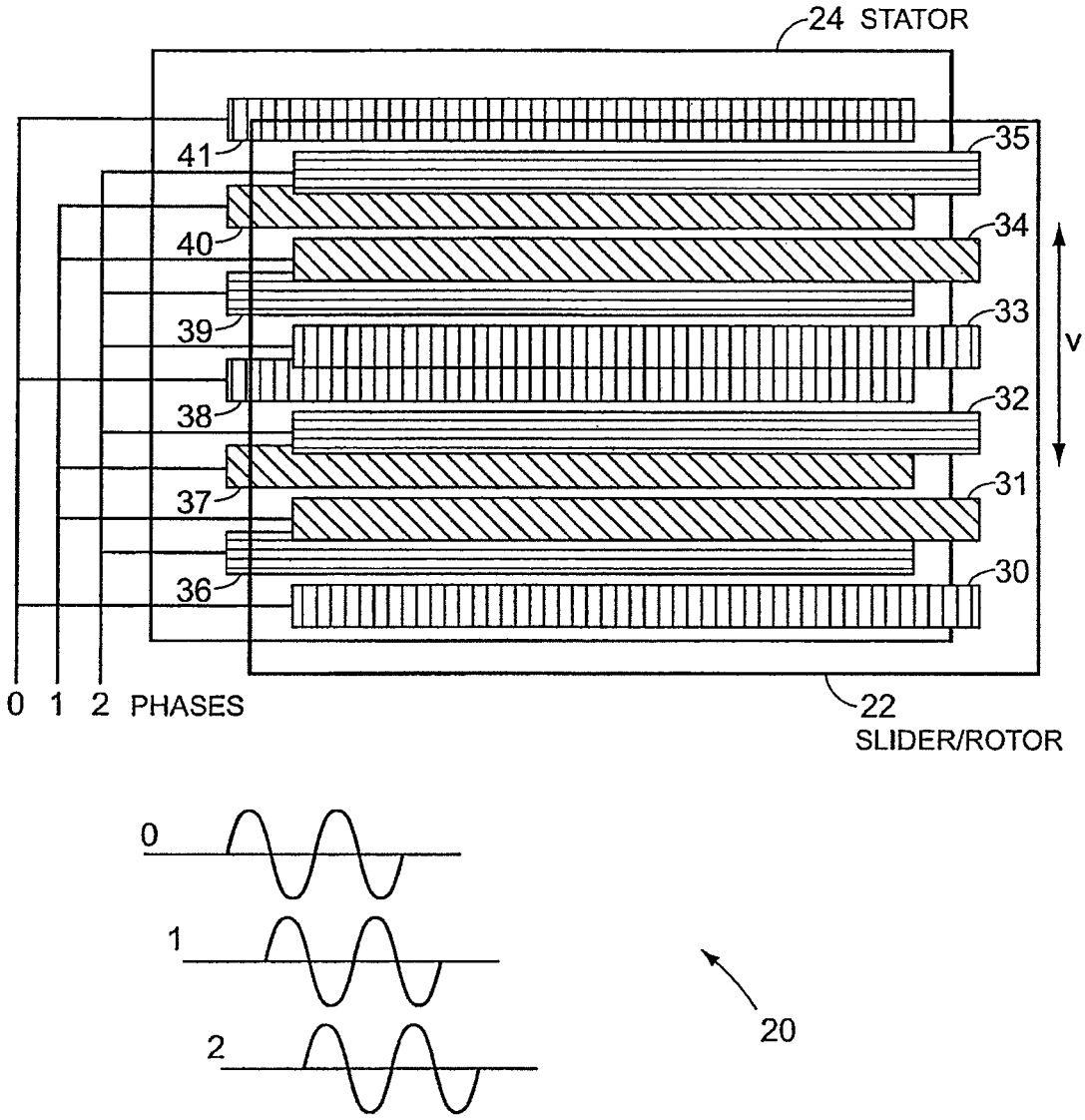
FIGS. 2*a-f* illustrate the respective structure and operation of electrostatic actuators.

FIG. 2*a* illustrates a basic linear electrostatic actuator with a stator and slider driven by a 3-phase a-c signal (alternating current signal). The three signals are preferably offset by $2\pi/3$ and thus constitute the 3-phase a-c signals. The electrode strips (conductors 30-41) are arranged sequentially in three groups, and the arranging order of the electrodes in the stator 24 is reversed with respect to the arranging order of the electrodes in the slider 22. The electrodes strips in both the stator and slider are implanted on an insulating dielectric material that allows the slider to glide over the stator without shorting the strips. By applying the 3-phase a-c signals to the electrodes (30-41), traveling potential waves are induced on the stator and the slider. The connecting order of the three phases in the slider are reversed from that in the stator. So the induced potential waves in the slider 22 and stator 24 propagate in opposite directions, but their velocity is similar. The waves having offset phases generate a Coulomb force between the electrode strips of the stator and slider from static electricity; and the Coulomb force moves the slider relative to the stator (in this configuration) along the arranged direction of the electrode strips. Namely, the slider is driven by electrostatic interaction between the two waves and its speed, v, is the differential between the speeds of the waves, i.e., twice the traveling wave velocity.

Figure 2B:
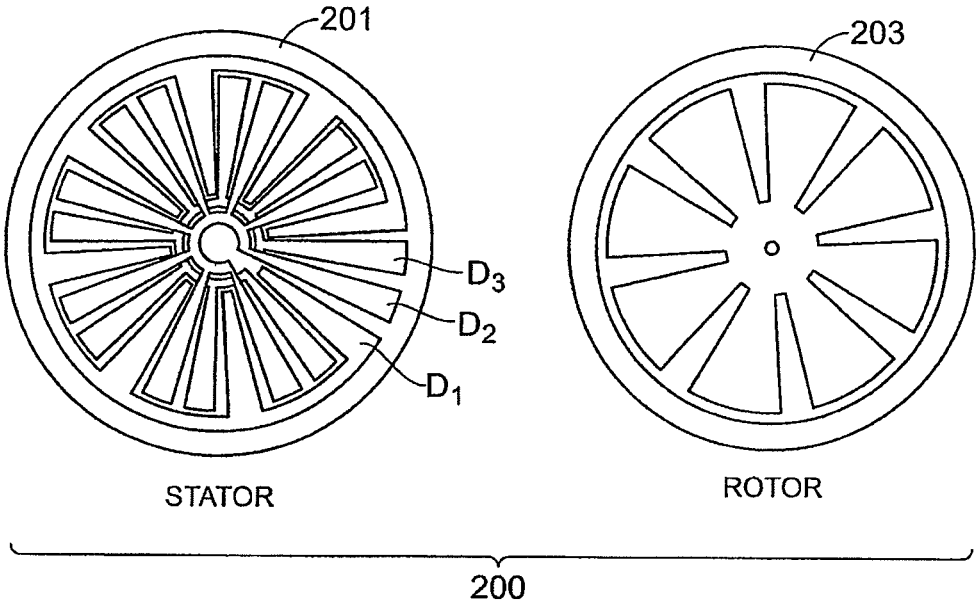

FIG. 2*b* shows the two parts of a rotary type electrostatic actuator: the stator 201 and the rotor 203 which when assembled is supported rotatably over the stator (not shown). The electrodes in the stator (D1, D2, D3) are connected to the 3-phase a-c signal source, each receiving one phase high-voltage a-c signal independently. The rotor is kept at 0 volts potential (ground). The rotary type electrostatic actuator can be turned controllably by application of the a-c signals with the $2\pi/3$ phase offset between them.

Figure 2C:
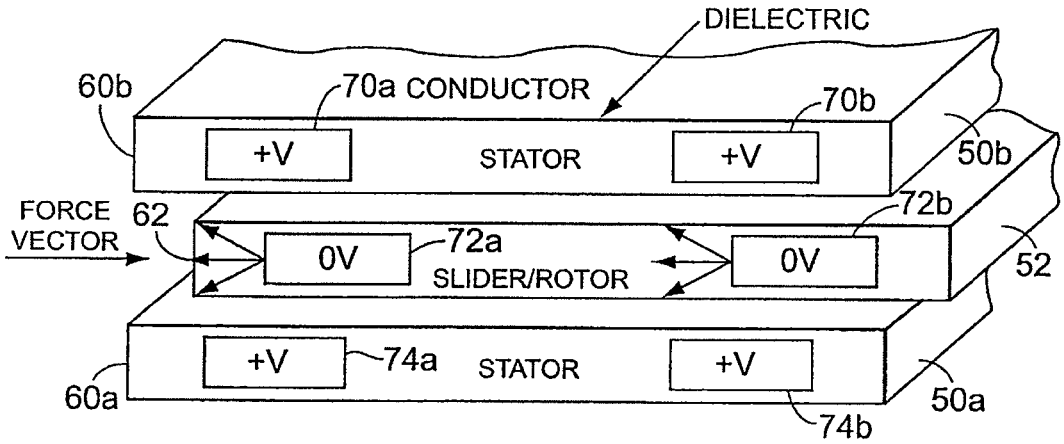
Figure 2D:
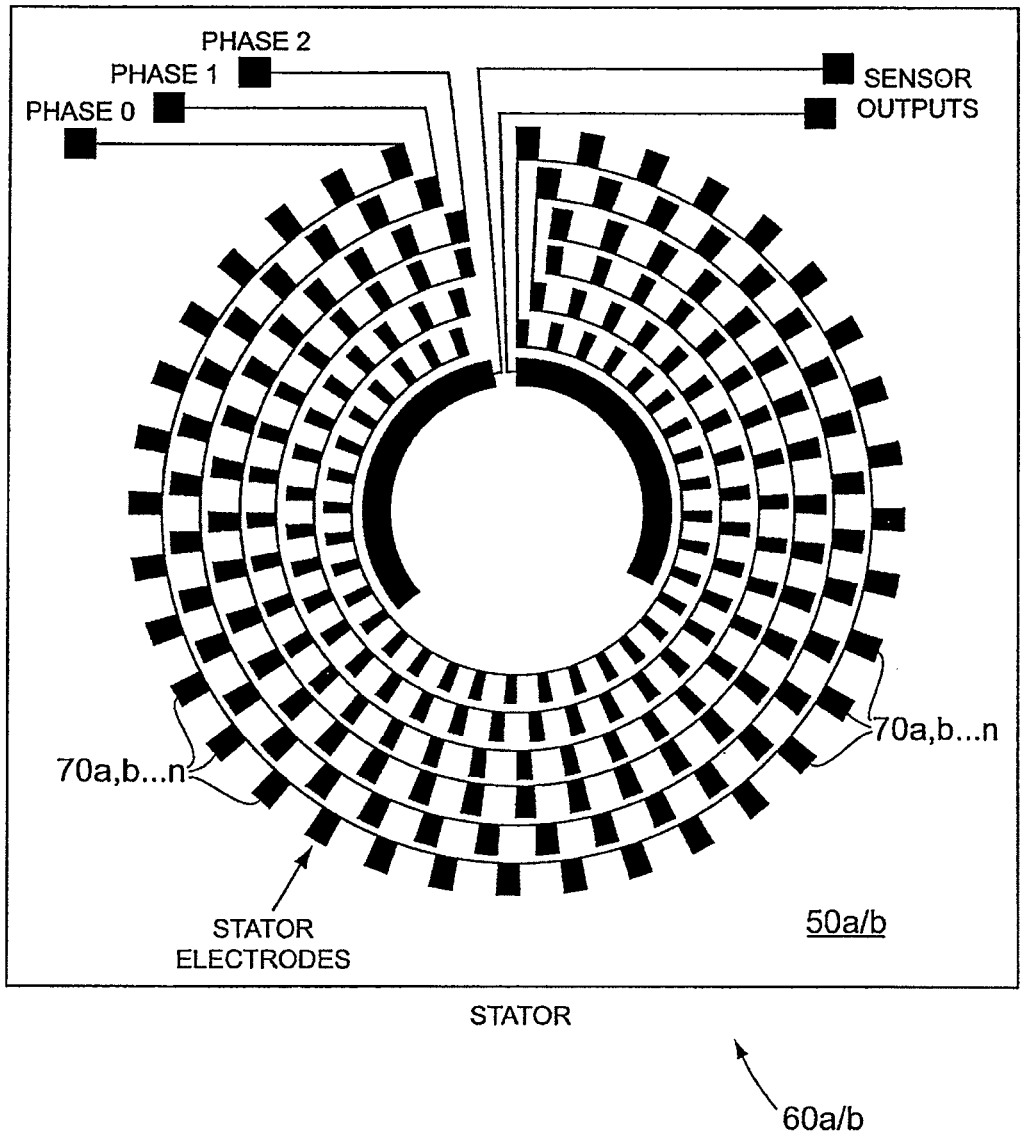
Figure 2E:
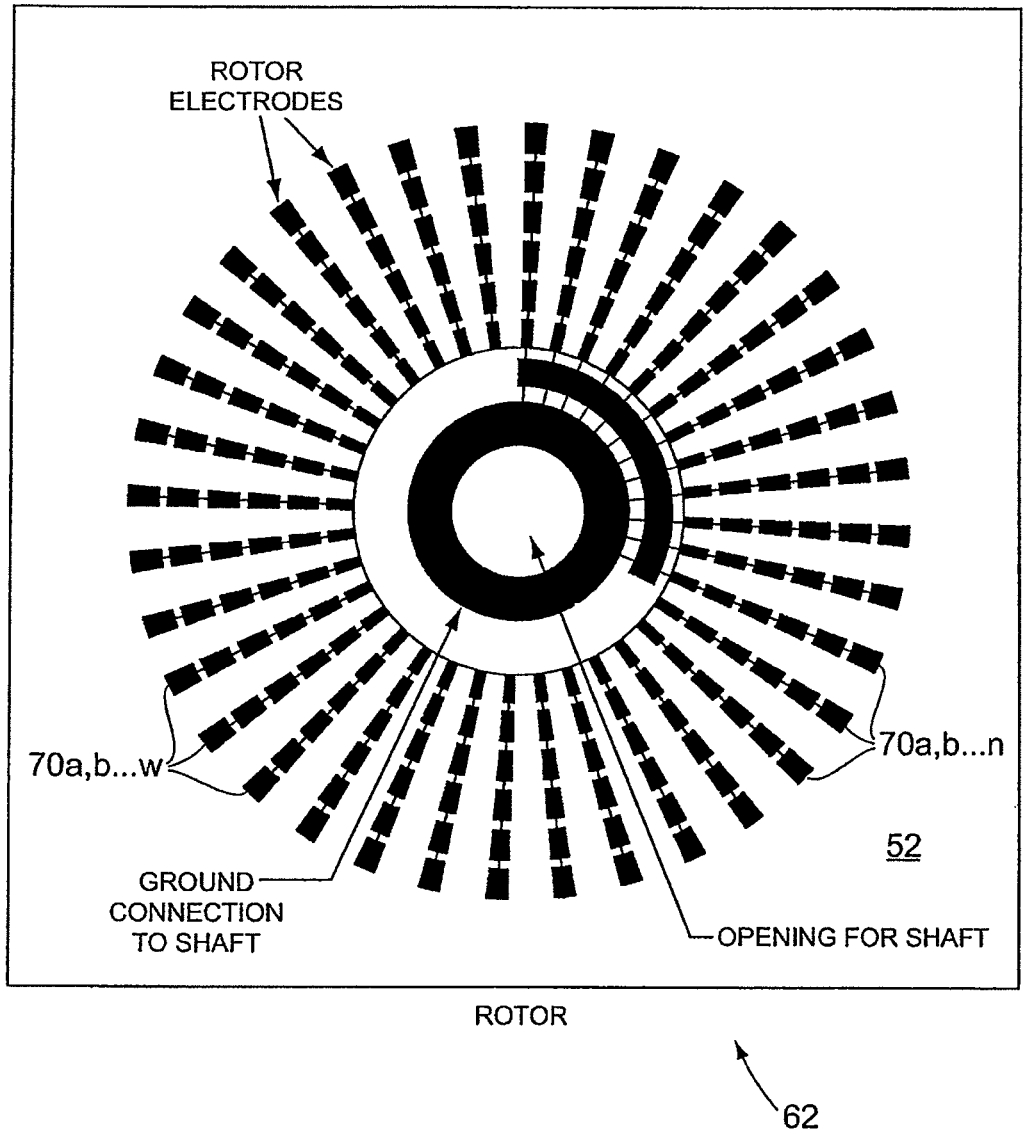
Figure 2F:
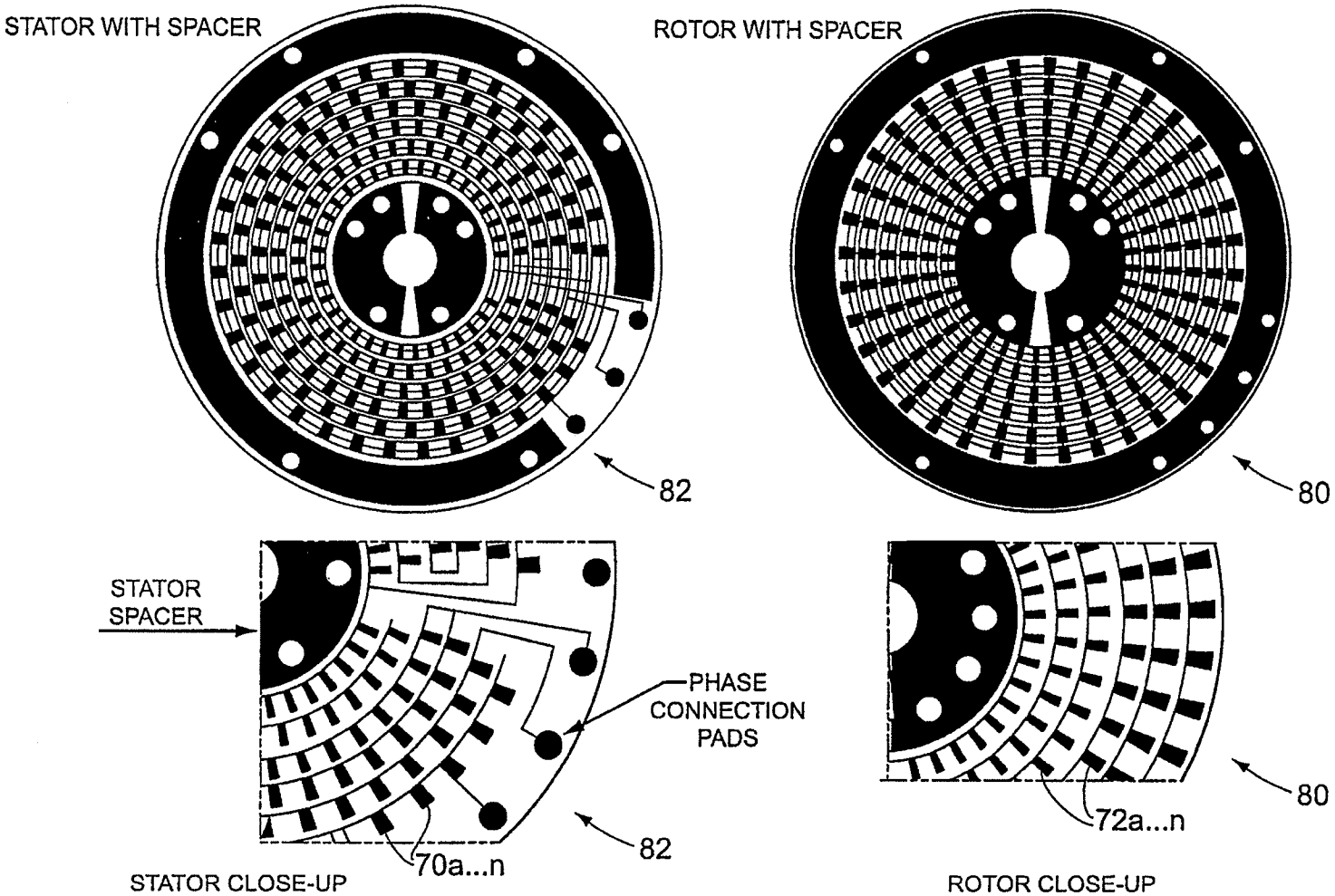

FIG. 2*c* illustrates a basic theory of operation of both the rotary and linear actuators with a cutaway view of moving electrodes between two pairs of stationary electrodes (conductors above and below). As before, the rotor electrodes are grounded (0 V) while the stator electrodes are driven by high ac voltage (+V). The voltage limit depends on the breakdown characteristics of the insulating material 50*a,b* and 52. The insulating substrates 50*a,b* and 52 are formed from dielectric materials. Notably, the configuration of the stator and rotor electrodes in FIGS. 2*d-f* are markedly different from the configuration in FIG. 2*b*, and they allow higher voltages at smaller geometries. This is due to the fact that each of the three electrode groups is driven at a different radial distance from the center of rotation and the difference in radial distance is sufficient to keep the three phases apart, thus allowing the narrow gaps between the electrodes of the same phase on the same radial circle. Indeed, for the geometries of interest as shown for example in FIGS. 2*d*-2*f*, the voltage can reach 1 to 4 KV. Returning for moment to the model in FIG. 2*c*, when the high voltage is applied, the rotor electrode strips are attracted to the stationary electrodes above and below, and although the upward and downward forces cancel each other the fringe forces pull (or rotate) the rotor as shown. As further shown in FIG. 2*f*, the 3-phase signals are applied to the connections on the stator. The phases are offset from each other and the voltages can be sequenced to drive the rotor in either direction.

There is a standard scale of muscle strength called the Oxford Scale, and that scale goes from no contraction all the way up to full power. The actuator is designed to supply sufficient power to the active support device for moving higher in the Oxford scale, say, from 2 to 3 in the scale, for one who can barely move the knee, to a level of substantial power strength. Relatively speaking, although not shown in the foregoing diagrams, the stator and rotor can be stacked sequentially to form a light weight, high power, high torque actuator.

The battery compartment is part of the actuator or is attached to another part of the structural frame with wires connected to the actuator. Thus, unlike conventional devices this configuration is lighter, more compact, and allows better and easier mobility.

The control panel is part of the actuator or is attached to another part of the structural frame with wires connected to the actuator. Buttons of the control panel are preferably of the type that can be operated through clothing to allow the device mode to be changed when the device is hidden under the clothes.

When the invention is applied to joints other than the knee, the same principles apply. For instance, a device to aid in wrist movement has elastic bands coupling a small actuator to the hand and wrist. Joints with more than one degree of freedom may have a single device to assist/resist the primary movement direction, or may have multiple actuators for different degrees of freedom. Other potential candidates for assistance include the ankle, hip, elbow, shoulder and neck.

Rotation of the Tibia and Femur

In a preferred implementation, the actuator is of a rotary design type with the center of rotation of the actuator located close to the center of rotation of the knee joint. According to the knee anatomy, in flexion, the tibia lies beneath, and in line with, the midpoint of the patella (knee cap). As extension occurs, the tibia externally rotates and the tibia tubercle comes to lie lateral to the midpoint of the patella. When the knee is fully flexed, the tibial tubercle points to the inner half of the patella; in the extended knee it is in line with the outer half. Namely, the knee anatomy is constructed in such a way that a point on the lower leg does not move exactly in a circular arc. Thus, in order for the circular movement of the actuator to match the movement of the leg, the coupling from the rotor to the lower brace requires either an elastic coupling or a mechanical structure to couple the circular movement of the actuator with the near-circular movement of the portion of the brace attached to the lower leg.

Figure 3A:
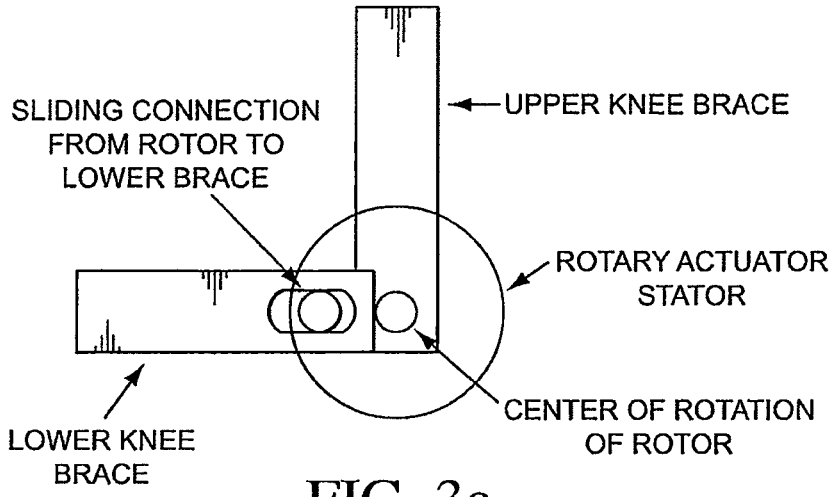
FIG. 3 is a diagram showing the mechanical linkage between the actuator and the body attachment brace.
Figure 3B:
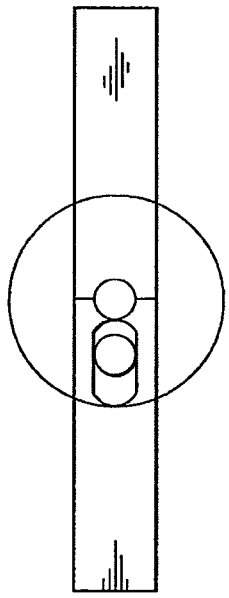

FIGS. 3*a* and 3*b* show a coupling mechanism that compensates for the movement of the center of rotation as the knee is flexed. FIG. 3*a* shows the knee flexed at 90 degrees, and FIG. 3*b* shows the knee fully extended. The center of rotation of the actuator is centered at the upper end of the lower leg (tibia) when extended, but shifts towards the posterior of the tibia when the knee is flexed. The sliding mechanism allows the actuator to apply assistance or resistance force at any angle of flexure.

If the center of rotation of the actuator is located a distance away from the joint, other coupling mechanisms can be used to couple the actuator to portion of the brace on the other side of the joint. The coupling mechanism can be constructed using belts, gears, chains or linkages as is known in the art. These couplings can optionally change the ratio of actuator rotation to joint rotation.

In an alternate implementation using a linear actuator, the linear actuator has the stator attached to the femur portion of the brace and the slider is indirectly connected to the tibial part of the brace via a connecting cable stretched over a pulley. The center of rotation of the pulley is close to the center of rotation of the knee. With this arrangement, a second actuator is required to oppose the motion of the first actuator if the device is to be used for resistance as well as assistance, or for flexion as well as extension.

Electronics and Control System Block Diagram and Operation

Figure 4:
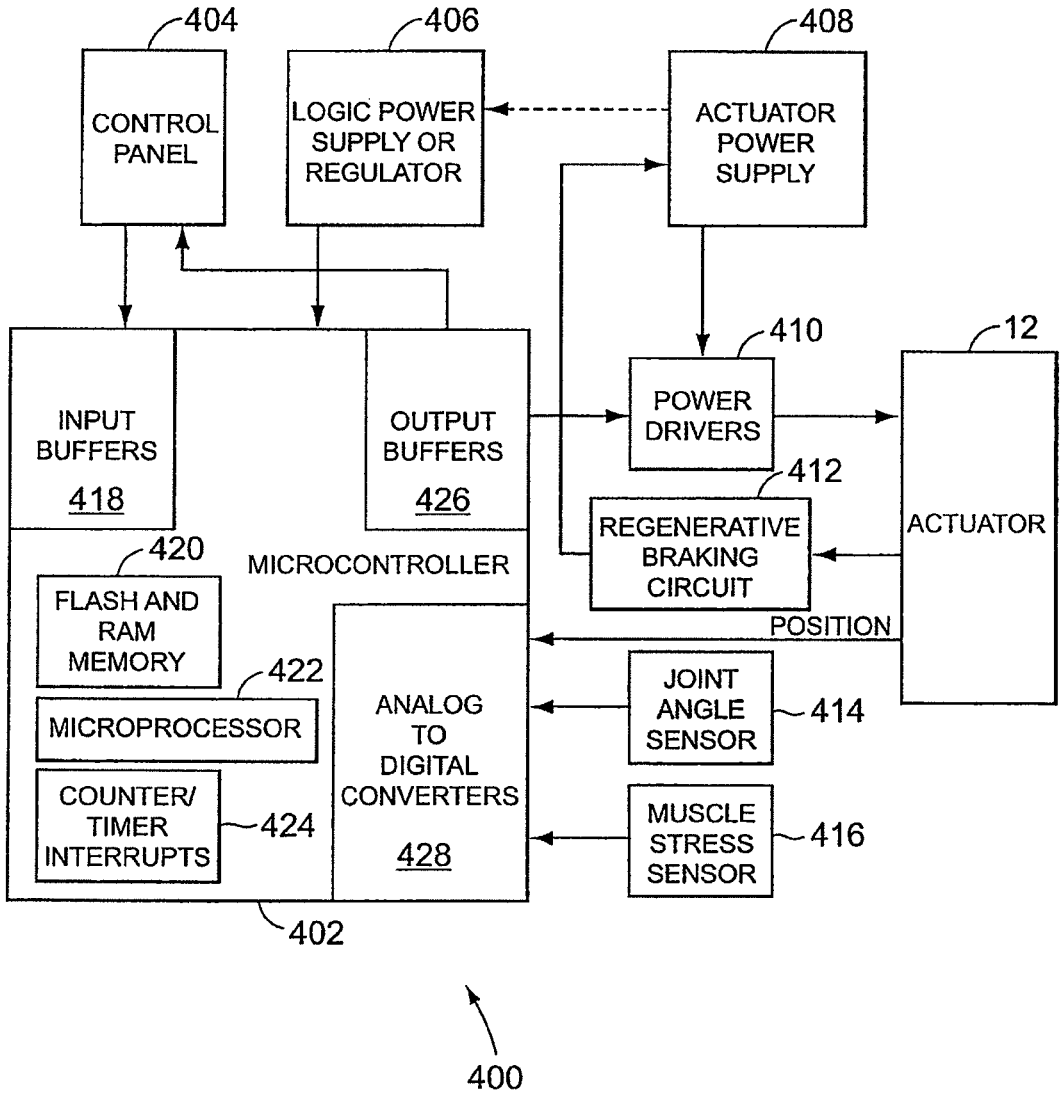
FIG. 4 is a block diagram showing the electronics used to drive and control the active muscle assistance device.

FIG. 4 is a block diagram showing the electronics and control system. The operation of the device is controlled by a program running in a microcontroller 402. To minimize the physical size of the control system the microcontroller is selected based on the scope of its internal functionality. Hence, in one implementation, the microcontroller is the Cygnal 8051F310, although those skilled in the art will recognize that many current and future generation microcontrollers could be used. In addition, some of the internal functions of the 8051F310 could be implemented with external components instead of internal to the microcontroller.

The microcontroller 402 is coupled to a control panel 404 to provide user control and information on the desired mode of operation. The control panel includes a set of switches that can be read through the input buffers 418 of the microcontroller. The control panel also may have a display panel or lights to display information such as operational mode and battery state. The control panel also includes means to adjust the strength of assistance and resistance in order to customize the forces to the ability of the user. Another embodiment of the control panel is a wired or wireless connection port to a handheld, laptop or desktop computer. The connection port can also be used to communicate diagnostic information and previously stored performance information.

Outputs of the microcontroller, provided from the output buffers 426, are directed in part to the actuator 12 through a power driver circuit 410 and in part to the control panel 404. In the preferred embodiment, the driver circuit converts the outputs to high voltage phases to drive an electrostatic actuator. The power driver circuit includes transformers and rectifiers to step up a-c waveforms generated by the microcontroller.

Note that an actuator as shown in FIGS. 2*d*-*f* allows also pulsed signals rather than sinusoidal wave shaped signals and, accordingly, the power drivers are configured to generate high-voltage multi-phase pulsed signals. Moreover, in instances where the actuator is a DC motor, servomotor, or gear motor, the power driver circuit is designed to generate high-current multi-phase signals.

When the operation mode of the muscle assistance device is set to apply a force that opposes the motion of the joint, the energy input from that 'external' force must be absorbed by the control circuit. While this energy can be dissipated as heat in a resistive element, it is preferably returned to the battery in the actuator power supply 408 via a regeneration braking circuit 412. This concept is similar to "regenerative braking"

found in some types of electric and hybrid vehicles to extend the operation time before the battery needs to be recharged.

The microcontroller 402 receives analog sensor information and converts it to digital form with the analog-to-digital converters 428. The joint angle sensor 414 provides the joint angle through a variable capacitor implemented as part of the electrostatic actuator (see e.g., FIGS. 2*d-f*). Alternatively, joint angle can be supplied by a potentiometer or optical sensor of a type known in the art.

When the invention is used to assist leg extension, the muscle stress sensor 416 is implemented as a foot-pressure sensor wired to the active brace. This sensor is implemented with parallel plates separated by a dielectric that changes total capacitance under pressure. In one implementation the foot sensor is a plastic sheet with conductive plates on both sides so that when pressure is applied on the knee the dielectric between the plates compresses. The change in the dielectric changes the capacitance and that capacitance change can be signaled to the microcomputer indicating to it how much pressure there is on the foot. There are pressure sensors that use resistive ink that changes resistance when pressure is applied on it. Other types of pressure sensors, such as strain gauges can be alternatively used to supply the pressure information. These sensors are configured to detect the need or intention to exert a muscle. For example, the foot pressure sensor in conjunction with joint angle sensor detects the need to exert the quadriceps to keep the knee from buckling. Other types of sensors, such as strain gauges, could detect the intension by measuring the expansion of the leg circumference near the quadriceps. In another embodiment, surface mounted electrodes and signal processing electronics measure the myoelectric signals controlling the quadriceps muscle. When the invention is used for other muscle groups in the body, appropriate sensors are used to detect either the need or intention to flex or extend the joint being assisted. It is noted that there is a certain threshold (minimum amount of pressure), say 5 pounds on the foot, above which movement of the actuator is triggered.

As further shown in FIG. 4, there are additional analog signals from the actuator 12 to the microcontroller 402 (via the analog-to-digital converters 428). These signals communicate the fine position of the actuator to give the microcontroller precise information to determine which phase should be driven to move the actuator in the desired direction.

Power for the muscle assistance device comes from one or more battery sources feeding power regulation circuits. The power for the logic and electronics is derived from the primary battery (in the power supply 408). The batteries-charge state is fed to the microcontroller for battery charge status display or for activating low battery alarms. Such alarms can be audible, visible, or a vibration mode of the actuator itself. Alternatively, a separate battery can power the electronics portion.

Figure 5:
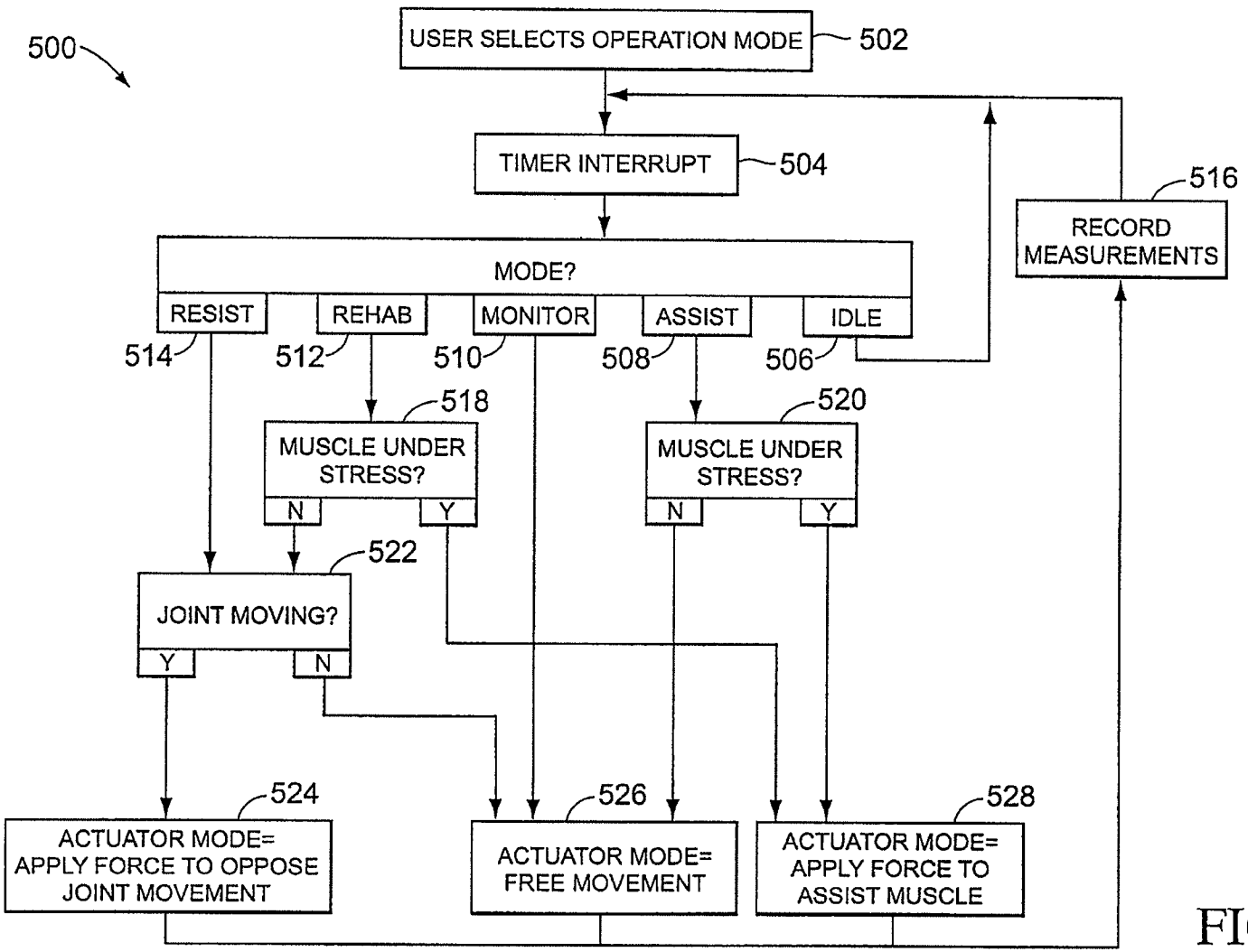
FIG. 5 is flowchart showing the modes of operation of a muscle assistance device.

Turning now to FIG. 5, the operation of the muscle assistance device is illustrated with a block diagram. The algorithm in this diagram is implemented by embedded program code executing in the microcontroller. In the first step of FIG. 5, the user selects a mode of operation 502. The modes include: idle 506, assist 508, monitor 510, rehabilitate 512, and resist 514.

In the idle mode 506, the actuator is set to neither impede nor assist movement of the joint. This is a key mode because it allows the device to move freely or remain in place when the user does not require assistance or resistance, or if battery has been drained to the point where the device can no longer operate. Idle mode requires the actuator to have the ability to allow free movement either with a clutch or an inherent free movement mode of the actuator, even when primary power is not available.

In the monitor mode 510, the actuator is in free movement mode (not driven), but the electronics is activated to record information for later analysis. Measured parameters include a sampling of inputs from the sensors and counts of movement repetitions in each activation mode. This data may be used later by physical therapists or physicians to monitor and alter rehabilitation programs.

In essence, there are instances when there is no need for any assistance from the active muscle support device and free movement of the leg is required. This is one reason for using an electrostatic actuator, rather than a standard DC motor. A standard DC motor or servo motor, needs to run at a fairly high speed to develop torque and requires a gear reduction between the motor and the load. Obviously, rotation of the knee (and actuator) does not complete a full circle, and the joint moves at a speed of about 1 revolution per 2 seconds (30 rpm). So, for moving the knee slowly at the required torque, a typical DC motor may have to run at speeds greater than 10,000 rpm and require a large gear ratio, e.g., more than 380:1. Then, when the actuator is not powered, the large gear ratio of the DC motor would amplify the frictional drag and greatly impede free movement of the knee. Another reason for preferring electrostatic actuators over standard DC motors is their weight. Motors are based on magnetic fields that are produced by heavy components such as high-current copper windings and iron cores. Conversely, electrostatic actuators can be constructed from lightweight polymers and thin, low current conducting layers, substantially reducing their weight.

In the assist mode 508, the actuator is programmed to assist movements initiated by the muscle. This mode augments the muscle, supplying extra strength and stamina to the user.

In the resist mode 514, the device is operating as an exercise device. Any attempted movement is resisted by the actuator. Resistance intensity controls on the control panel determine the amount of added resistance.

In the rehabilitate mode 512, the device provides a combination of assistance and resistance in order to speed recovery or muscle strength while minimizing the chance of injury. Assistance is provided whenever the joint is under severe external stress, and resistance is provided whenever there is movement while the muscle is under little stress. This mode levels out the muscle usage by reducing the maximum muscle force and increasing the minimum muscle force while moving. The average can be set to give a net increase in muscle exertion to promote strength training. A front panel control provides the means for setting the amplitude of the assistance and resistance.

Then, assuming that the rehabilitate mode 510 is selected, a determination is made as to whether the muscle is under stress. The indicia of a muscle under stress is provided as the output of the muscle stress sensor reaching a predetermined minimum threshold. That threshold is set by the microcontroller in response to front panel functions.

If the muscle is not under stress or if the resist mode 514 is selected, a further determination is made as to whether the joint is moving 522. The output of the joint position sensor, together with its previous values, indicate whether the joint is currently in motion. If it is, and the mode is either rehabilitate or resist, the actuator is driven to apply force opposing the joint movement 524. The amount of resistance is set by the microcontroller in response to front panel settings. The resistance may be non-uniform with respect to joint position. The resistance may be customized to provide optimal training for a particular individual or for a class of rehabilitation.

If the joint is not is motion 522 or the monitor mode 510 is selected, the actuator is de-energized to allow free movement of the joint 526. This is preferably accomplished by using an actuator that has an unpowered clutch mode.

Additionally, if the muscle is under stress 520 or 522 and either the rehabilitate or the assist modes are selected, the actuator is energized to apply force for assisting the muscle 528. The actuator force directed to reduce the muscle stress. The amount of assistance may depend on the amount of muscle stress, the joint angle, and the front panel input from the user. Typically, when there is stress on the muscle and the joint is flexed at a sharp angle, the largest assistance is required. In the case of knee assistance, this situation would be encountered when rising from a chair or other stressful activities.

As mentioned before, when the device is in monitor mode 510, measurements are recorded to a non-volatile memory such as the flash memory of the microcontroller (item 420 in FIG. 4). Measurements may include the state of all sensors, count of number of steps, time of each use, user panel settings, and battery condition. This and the step of uploading and analyzing the stored information are not shown in the diagram.

Figure 6:
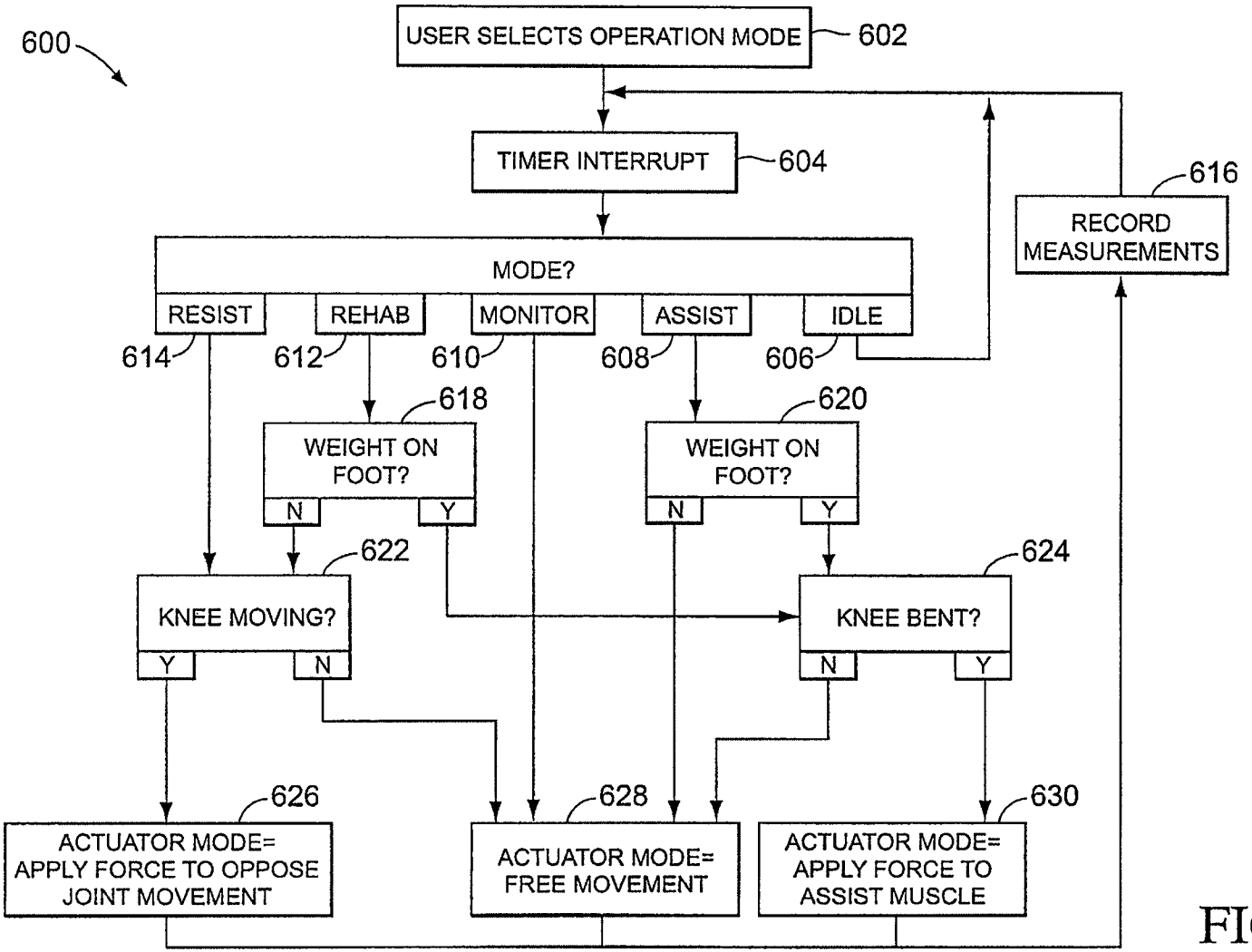
FIG. 6 is a flowchart of the modes of operation of a knee joint muscle assistance device.

FIG. 6 is a flow diagram specific to an active knee assistance device. This diagram assumes a specific type of muscle stress sensor that measures the weight on the foot. Relative to the diagram of FIG. 5, this diagram also shows a step (620) to determine whether the knee is bent or straight (within some variation). If the knee is straight, no bending force is needed 624 and power can be saved by putting the actuator in free-movement mode 630. To prevent problems such as buckling of the knee, the transitions, i.e., de-energizing the actuator, in both FIGS. 5 and 6 may be dampened to assure that they are smooth and continuous.

Software

The software running on the microcontroller may be architected in many different ways. A preferred architecture is to structure the embedded program code into subroutines or modules that communicate with each other and receive external interrupts (see item 424 in FIG. 4). In one implementation the primary modules include control panel, data acquisition, supervisor, actuator control, and monitor modules. A brief description of these modules is outlined below.

The control panel responds to changes in switch settings or remote communications to change the mode of operation. Settings are saved in a nonvolatile memory, such as a bank of flash memory.

The data acquisition module reads the sensors and processes data into a format useful to the supervisor. For instance, reading position from a capacitive position sensor requires reading the current voltage, driving a new voltage through a resistance, then determining the RC time constant by reading back the capacitor voltage at a later time.

The supervisor module is a state machine for keeping track of high-level mode of operation, joint angle, and movement direction. States are changed based on user input and sensor position information. The desired torque, direction and speed to the actuator control the functioning of this module. The supervisor module may also include training, assistance, or rehabilitation profiles customized to the individual.

The actuator control module is operative to control the actuator (low level control) and includes a control loop to read fine position of the actuator and then drive phases to move the actuator in the desired direction with requested speed and torque. Torque is proportional to the square of the driving voltage in an electrostatic actuator.

The monitor module monitors the battery voltage and other parameters such as position, repetition rates, and sensor values. It also logs parameters for later analysis and generates alarms for parameters out of range. This module uses the front panel or vibration of the actuator to warn of low voltage from the battery.

A number of variations in the above described system and method include, for example, variations in the power sources, microcontroller functionality and the like. Specifically, power sources such as supercapacitors, organic batteries, disposable batteries and different types of rechargeable batteries can be used in place of a regular rechargeable battery. Moreover, microcontroller functionality can be split among several processors or a different mix of internal and external functions. Also, different types of braces, with or without hinges and support frames, may be used for attachment to the body, and they may be of different lengths. Finally, various ways of communicating the 'weight-on-foot' may be used, either through wired or wireless connections to the control circuitry, or by making the brace long enough to reach the foot.

In summary, the present invention provides a light weight active muscle assistance device. And, although the present invention has been described in considerable detail with reference to certain preferred versions thereof, other versions are possible. Therefore, the spirit and scope of the appended claims should not be limited to the description of the preferred versions contained herein.

What is claimed is:

1. An active muscle assistance apparatus, comprising:

a brace having a first portion configured to be fastened to a user's leg above a knee and a second portion movably coupled to the first portion and configured to be fastened to the leg below the knee;

a foot pressure sensor;

a joint angle sensor configured to detect a knee angle;

an actuator coupled to the brace, the actuator operative, when energized, to exert force between the first and second portions to assist movement of the leg; and a controller coupled to the actuator and responsive to the foot pressure sensor and the joint angle sensor, the controller configured to trigger the actuator to apply force between the first and second portions to assist movement of the leg if foot pressure is over a threshold amount as sensed by the foot pressure sensor and if the detected knee angle detected by the joint angle sensor indicates that the leg is bent.

2. The apparatus of claim 1, further comprising a battery coupled with the actuator to supply electricity to the actuator.

3. The apparatus of claim 1, wherein the apparatus is a portable device.

4. The apparatus of claim 1, wherein the controller is further configured to vary the force exerted by the actuator between the first and second portions depending at least in part on the foot pressure sensor value, wherein varying the amount of force exerted by the actuator assists in movement of the leg.

5. The apparatus of claim 1, wherein the controller and actuator are further configured to allow free movement between the first and second portions if no leg movement assistance is required.

6. The apparatus of claim 5, wherein the controller and actuator are further configured to allow free movement between the first and second portions based on a detected angle of the user's knee.

7. A method of assisting movement of a user's leg, comprising:

fastening a first portion of a brace to the leg above the knee and a second portion of a brace to the leg below the knee, the first portion and the second portion being movably coupled;

detecting a foot pressure value;

detecting a knee angle; and if the foot pressure sensor value exceeds a threshold, and if the knee angle indicates that the leg is bent, applying an amount of force between the first and second portions to assist movement of the leg.

8. The method of claim 7, wherein applying an amount of force comprises applying force with an actuator coupled to the brace.

9. The method of claim 7, further comprising detecting an intention to exert a muscle by detecting the intention to exert a quadriceps of the leg.

10. The method of claim 7, wherein the amount of force applied is varied based on the detected knee angle and the foot pressure sensor value.

11. The method of claim 7, wherein the applying and detecting steps occur while the user is walking.

12. The method of claim 7 further comprising varying the amount of force applied to the first and second portions based on the foot pressure sensor value to assist in movement of the leg.

13. The method of claim 7 further comprising allowing free movement between the first and second portions if no leg movement assistance is required.

14. The method of claim 13 wherein the step of allowing free movement comprises allowing free movement between the first and second portions based on the angle of the user's knee.

15. The method of claim 7 further comprising, if the foot pressure sensor value does not exceed the threshold, allowing free movement between the first and second portions.

* * * * *